US009745109B2

(12) United States Patent
Lepage

(10) Patent No.: US 9,745,109 B2
(45) Date of Patent: Aug. 29, 2017

(54) CLOSURE

(75) Inventor: Francis Lepage, Dommartin (FR)

(73) Assignee: OBRIST CLOSURES SWITZERLAND GMBH, Reinach (CH)

( * ) Notice: Subject to any disclaimer, the term of this patent is extended or adjusted under 35 U.S.C. 154(b) by 0 days.

(21) Appl. No.: 13/702,970

(22) PCT Filed: Jul. 6, 2011

(86) PCT No.: PCT/IB2011/001912

§ 371 (c)(1),
(2), (4) Date: Feb. 27, 2013

(87) PCT Pub. No.: WO2012/004668

PCT Pub. Date: Jan. 12, 2012

(65) Prior Publication Data

US 2013/0206761 A1 Aug. 15, 2013

(30) Foreign Application Priority Data

Jul. 9, 2010 (GB) ..... 1011663.0

(51) Int. Cl.

| | |
|---|---|
| ***E06B 3/34*** | (2006.01) |
| ***B65D 51/00*** | (2006.01) |
| ***E05D 15/00*** | (2006.01) |
| ***B65D 47/08*** | (2006.01) |

(52) U.S. Cl.

CPC ..... *B65D 47/08* (2013.01); *B65D 47/0809* (2013.01); *B65D 47/0842* (2013.01); *B65D 51/00* (2013.01); *B65D 2251/065* (2013.01)

(58) Field of Classification Search

CPC B65D 47/08; B65D 47/9809; B65D 47/0842; B65D 47/0804; B65D 47/0833; B65D 47/0857; B65D 51/00; B65D 1/32; E06B 3/34; E05D 15/00

USPC ..... 220/200, 254.1, 254.3, 254.6; 215/235, 215/321; 222/546, 212, 556

See application file for complete search history.

(56) References Cited

U.S. PATENT DOCUMENTS

| | | | | |
|---|---|---|---|---|
| 5,067,624 | A | 11/1991 | Thanisch | |
| 5,979,706 | A | 11/1999 | Grussmark | |
| 6,095,374 | A | 8/2000 | Ricard et al. | |
| 6,116,477 | A * | 9/2000 | Kreiseder et al. | 222/556 |
| 6,840,409 | B2 * | 1/2005 | Dambricourt | 222/212 |
| D529,812 | S * | 10/2006 | Ratzlaff | D9/529 |
| 7,731,066 | B2 * | 6/2010 | Norris et al. | 222/494 |

(Continued)

FOREIGN PATENT DOCUMENTS

| | | |
|---|---|---|
| CA | 2406986 | 8/2002 |
| FR | 2540834 | 2/1983 |

(Continued)

OTHER PUBLICATIONS

Prior, Michael "Search Report" Great Britain Intellectual Property Office, Application No. GB1011663.0; dated Oct. 28, 2010, p. 1.

(Continued)

*Primary Examiner* — Andrew Perreault

(74) *Attorney, Agent, or Firm* — Nicholas J. Landau; Bradley Arant Boult Cummings LLP

(57) ABSTRACT

A container closure (10) is provided and comprises a base (50) and a lid (55), and the footprint of the lid is larger than the footprint of the base.

20 Claims, 18 Drawing Sheets

(56) References Cited

U.S. PATENT DOCUMENTS

| | | | | |
|---|---|---|---|---|
| 2004/0099692 | A1 | 5/2004 | Dambricourt | |
| 2008/0093327 | A1 * | 4/2008 | Stolle | 215/235 |

FOREIGN PATENT DOCUMENTS

| | | |
|---|---|---|
| GB | 2422372 | 7/2006 |
| JP | 2001278321 | 10/2001 |
| JP | 2008100749 | 5/2008 |
| JP | 20091309 | 8/2009 |
| WO | WO 2011031985 A2 * | 3/2011 |

OTHER PUBLICATIONS

Cappiello, Gennaro "Notification of Transmittal of the International Search Report and the Written Opinion of the International Searching Authority" European Patent Office, PCT/IB2011/001912; dated Oct. 18, 2011, pp. 1-12.

* cited by examiner

CLOSURE

CROSS-REFERENCE TO RELATED APPLICATIONS

This application is a national stage under 35 U.S.C. 371 of International Application PCT/IB2011/001912, filed on Jul. 6, 2011 (currently pending). International Application PCT/IB2011/001912 cites the priority of British Patent Application 1011663.0, filed Jul. 9, 2010 (currently pending).

The present invention relates generally to a container closure and particularly to a closure comprising a base and a lid.

It is known to provide closures for containers which comprise a base connectable to a container and a lid for closing the base. An important consideration when producing closures is to attempt to minimise the amount of material required; however, this must not come at the expense of the performance of the closure.

The present invention seeks to address the problems with known closures.

According to a first aspect of the present invention there is provided a container closure comprising a base and a lid, the footprint of the lid being larger than the footprint of the base.

The present invention is based upon a "big lid, small base" principle in which the base and lid do not have to be the same size as each other, in other words the lid does not have to fit flush onto the base. Effectively, therefore, a deliberate overhang is created. This allows, for example, the dimensions of a base to be minimised whilst maintaining a required exterior appearance with the closure in a closed position, that is with just the lid in view.

The extent to which the footprint of the lid is larger than the footprint of the base can be selected based on the particular requirements of a container pack. For example, the lid may be: approximately 10% larger; larger by an amount in the range of 10% to 100%; larger by an amount in the range of 100% to 200%; larger an amount in the range 200% to 500%; or larger by an amount in the range 500% to 1,000%. The size difference may fall outside of these ranges if appropriate.

The base may be connected to the d by a hinge, for example a snap hinge or film hinge. The hinge may be at least partly external, for example extending from an external surface of the lid. In other embodiments the lid is attachable to the base but removable therefrom for example using a screw- or snap-engagement system.

The base may be provided with engagement means far engaging a container, for example screw threads or snap engagement means.

The footprint of the lid and/or base may be selected to match corresponding components of a container. For example, the lid may be sized (e.g. minimised) to be flush fitting with a container shoulder; and the base may be sized to match a container neck or an equivalent structure such as a gully with engagement means for connecting to the base. This allows a closure with the minimum amount of material to be formed. In one embodiment the periphery of the lid is substantially flush with the periphery of a container when they meet in a closed position.

The shape of the base may be substantially the same as the shape of the lid when viewed in plan, or the shapes may be different. For example, a circular base may be used in combination with an ellipsoidal lid The lid may be formed to seal the base, for example by blocking a dispensing orifice formed in the base.

The base may be located substantially centrally with respect to the lid when viewed in plan, although offset arrangements are possible.

The present invention also provides a container having a closure as described herein.

The present invention will now be more particularly described, by way of example, with reference to the accompanying drawings, in which.

Figure 2:
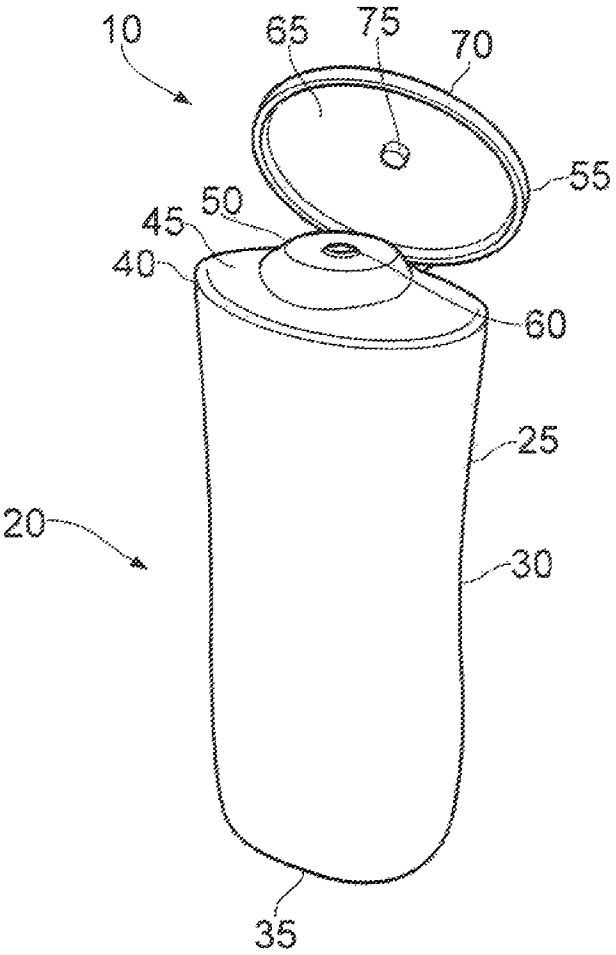
FIG. 2 is a perspective view of the closure of FIG. 1 shown in an open position.
Figure 1:
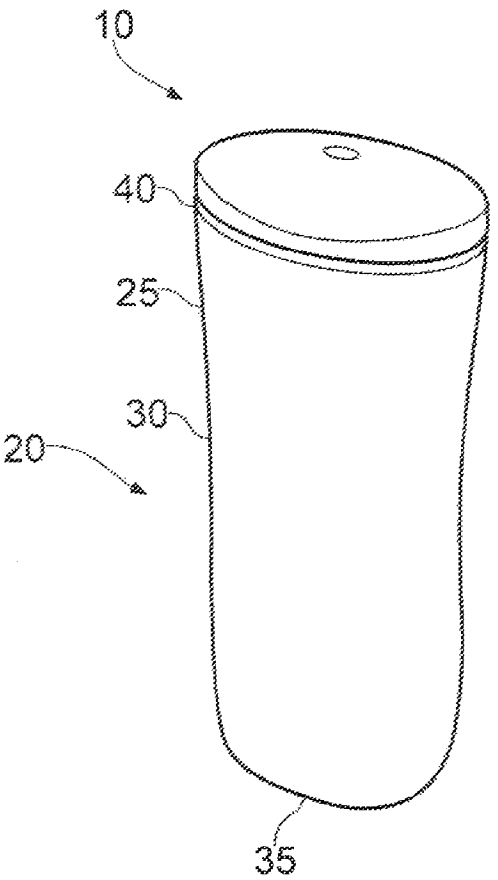
FIG. 1 is a perspective view of a closure formed according to the present invention shown connected to a container.
Figure 3:
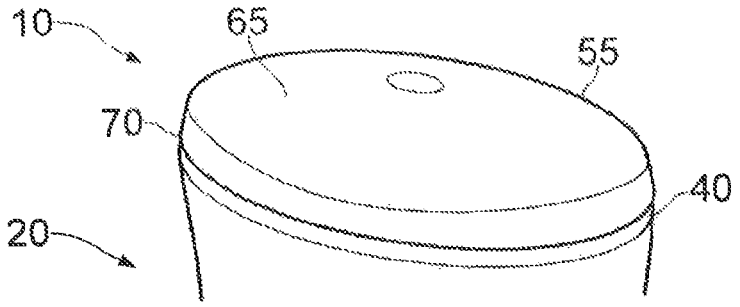
FIG. 3 is a magnified view of the closure of FIG. 1.
Figure 4:
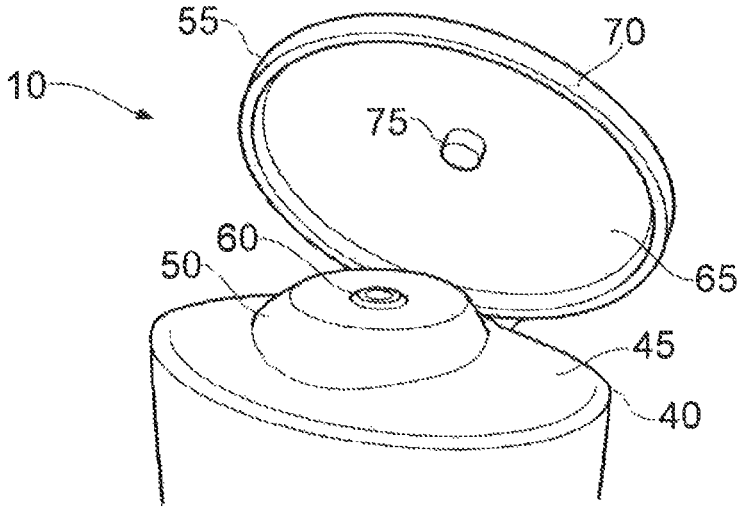
FIG. 4 is a magnified view of the closure of FIG. 5.

Referring first to FIGS. 1 to 4 there is shown a closure generally indicated 10 connected to a container generally indicated 20.

The container 20 comprising on elongate hollow body 25 with a generally ellipsoidal section and having a shallow wasted portion 30 approximately half way along its length. At one end of the body 25 the container is closed by a base 35. At the other end of the body 20 is a shoulder region 40 which merges into a top panel 45. The panel 45 includes an opening (not shown) through which product carried in the container 20 can pass. The opening is covered by the closure 10.

The closure 10 comprises a base 50 and a lid 55.

Figure 5:
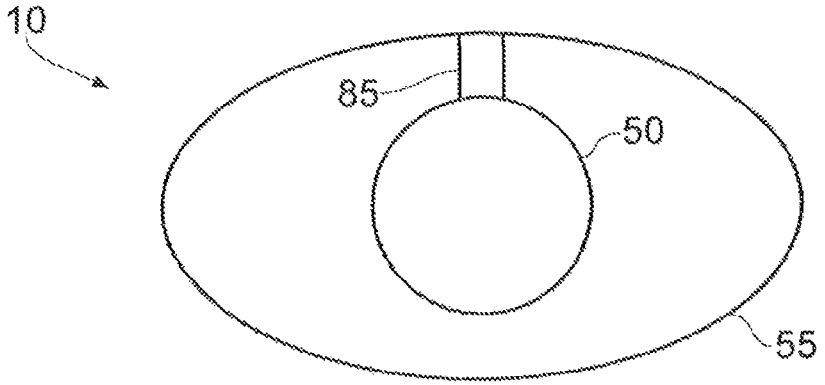
FIG. 5 is a schematic under plan view of the closure of FIGS. 1 to 4.

The base 50 is generally circular and is connected to the panel 45, in this embodiment by a snap-fit engagement. The base 50 includes a central dispensing orifice 60 through which product from the container 20 can pass the base 50 is connected to the lid 55 by a hinge element 85 shown best in FIG. 5. The lid 65 comprises a generally ellipsoidal-shape top plate which is convexly domed. A shallow side wall 70 depends from the periphery of the plate 65. A spigot 75 depends from the underside of the plate 65 and is positioned centrally so that in the close position shown in FIGS. 1 and 3 it engages into the orifice 60 to seal it.

The lid 55 is dimensioned to match the outline of the shoulder region 40 on the container body. it will be noted that the lid 55 is significantly (in this embodiment) approximately 3 times) larger than the base 50. This means, therefore, that in the closed position shown in FIGS. 1 and 3 the lid 55 is flush with the container body 25, but is not flush with the base 50, which is dimensioned to fit around the body orifice. The closure 10 is therefore presented in a "small base with big lid" format that allows the material for the base 50 to be reduced whilst maintaining a flush-fitting lid 55. In other words, the base and lid are not flush fitting.

Figure 6:
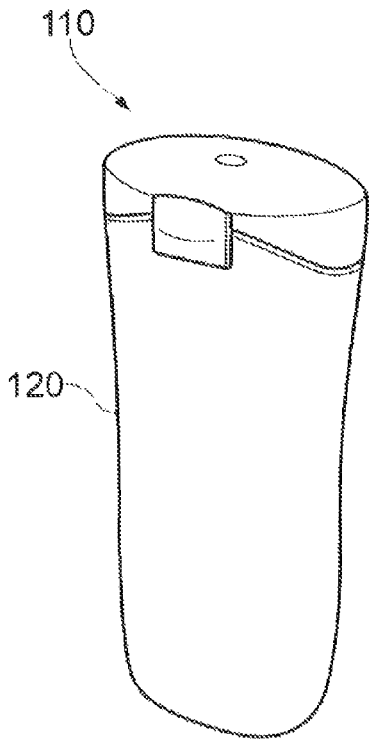
FIG. 6 is a perspective view of a closure formed according to an alternative embodiment and shown attached to a container.
Figure 7:
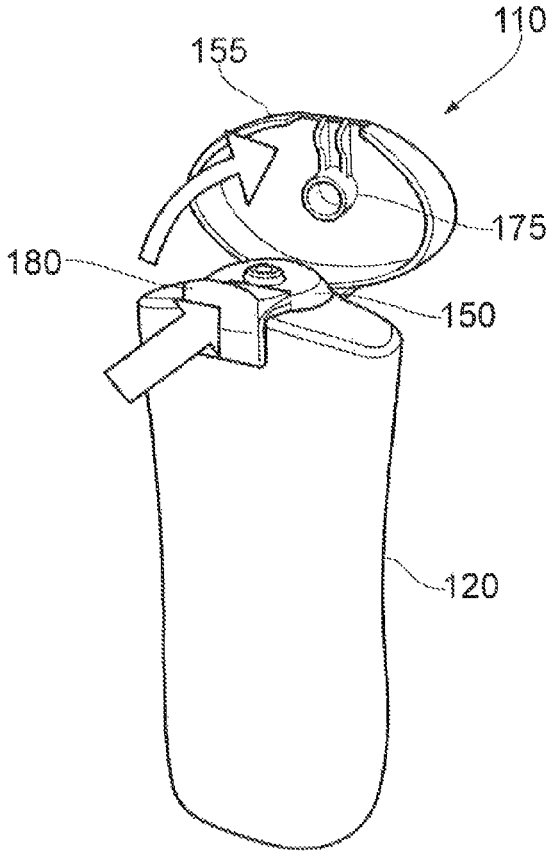
FIG. 7 is a perspective view of the closure of FIG. 6 shown in an open position.

Referring now to FIGS. 6 and 7 there is shown a closure 110 formed according to an alternative embodiment and connected to a container 120. The container 120 and closure 110 are very similar to the container and closure of FIGS. 1 to 5. However, in this embodiment the closure 110 is provided with an opening mechanism which allows for one-handed opening.

The closure 110 comprises a base 150 and a lid 155. The spigot 175 on the lid 155 is arranged to hold the lid firmly on the base in the closed position shown in FIG. 6 a lever 180 is provided at the front of the base 150. The closure is arranged so that in a first phase of the opening the lever is activated but does not release the locking forces. As the unlocking mechanism moves in this phase it causes energy to be stored in the form of deformation of the lid and/or the base. When the unlocking mechanism reaches its final position the lock is released and the stored energy is released to flip open the lip. In this respect the mechanism is similar to that shown in patent document number EP1619134, the content of which are incorporated herein by reference.

As with the closure showing in FIGS. 1 to 5, the lid 155 is significantly larger than the base 150 thus providing the some benefit in material reduction.

Figure 8:
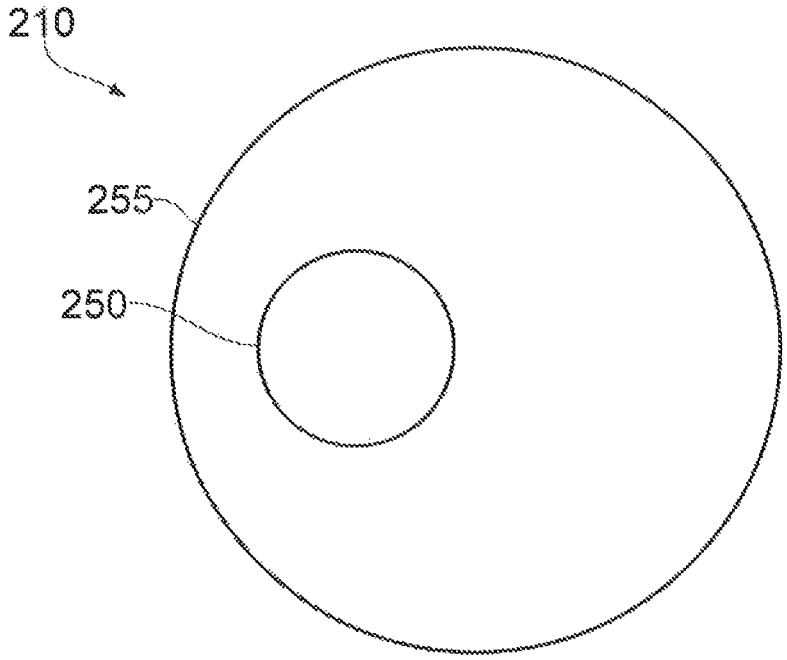
FIG. 8 is a schematic under plan view of a closure formed according to an alternative embodiment.

Referring now to FIG. 8 there as shown a closure 210 formed according to on alternative embodiment.

The closure 210 comprises a generally circular base 250 and a generally circular lid 255. The base 250 is connectable to a container (not shown). The lid 255 is attachable to the base 250 by cooperating formations, in this embodiment screw thread formation (not shown).

The lid 255 is considerably larger than the base 250 and thus a significant overhang is Present. The base 250 is offset from the centre of the lid 255.

Figure 9:
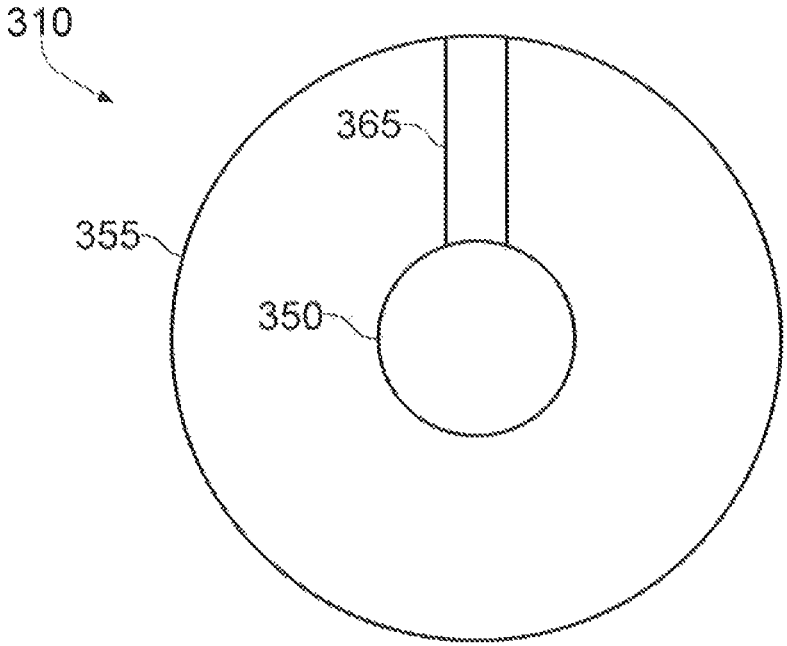
FIG. 9 is a schematic under plan view of a closure formed according to a further embodiment.

Referring now to FIG. 9 there as shown a closure 310 formed according to an alternative embodiment. The closure 310 comprises a circular base 350 and a circular lid 355. In this embodiment the base is positioned generally centrally with a respect to the lid. The base 350 and lid 355 are connected by a strap hinge 365.

Figure 10:
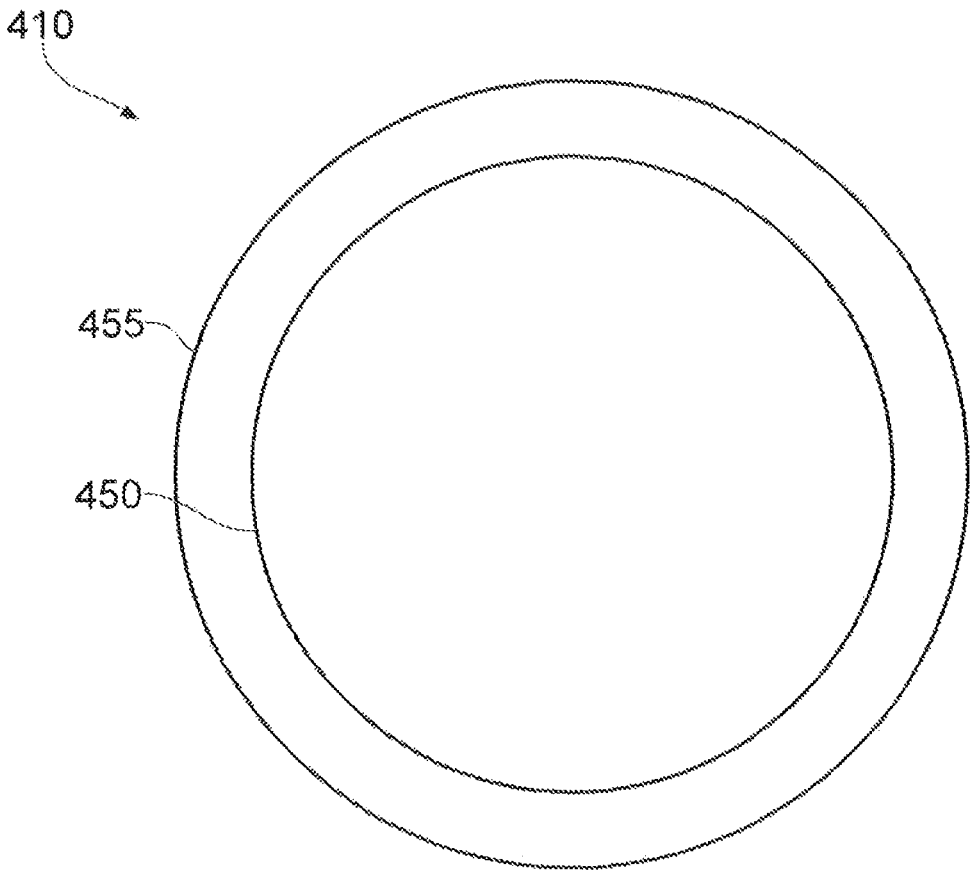
FIG. 10 is a schematic under plan view of a closure formed according to a still further embodiment.
Figure 11:
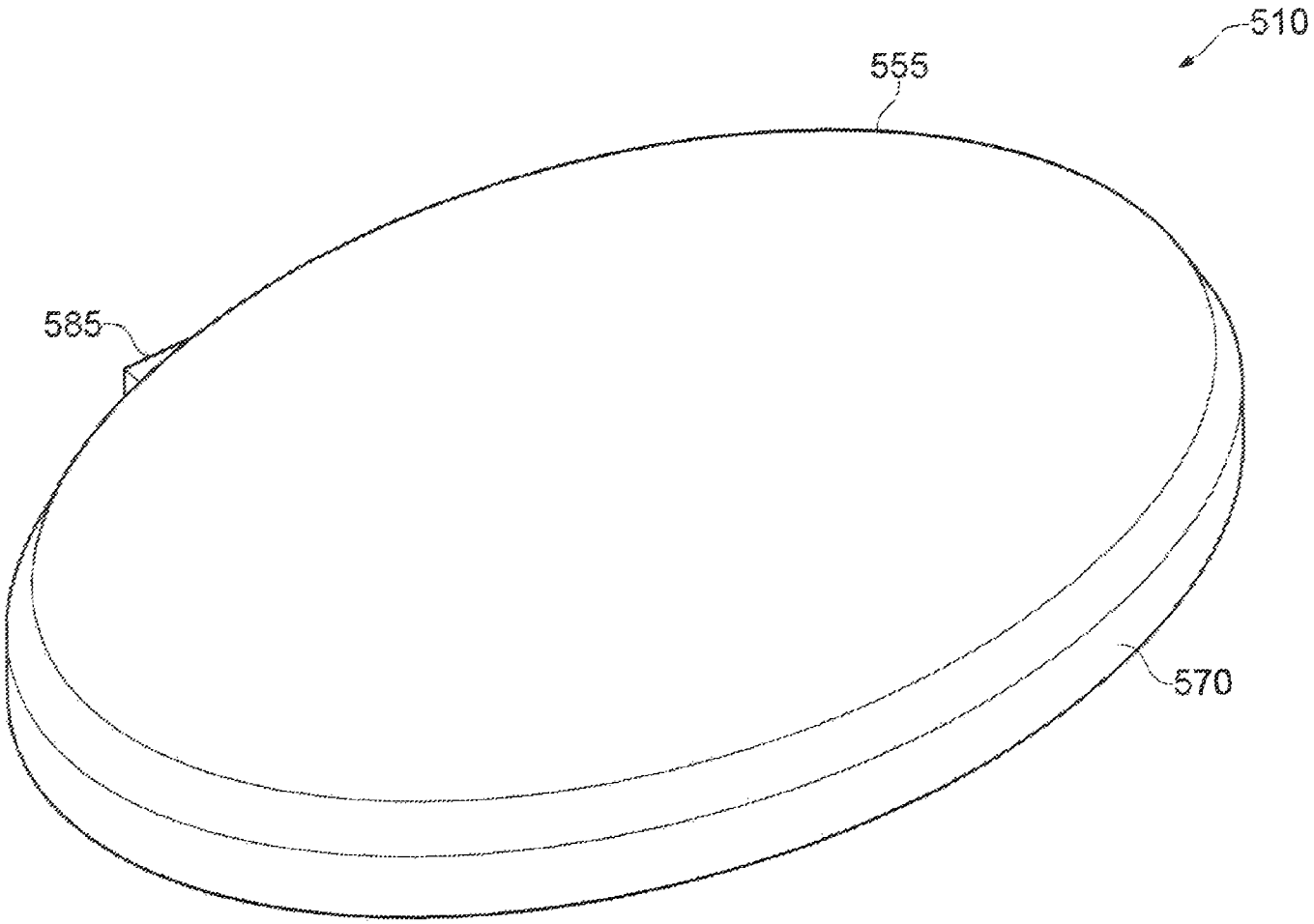
FIG. 11 is a front perspective view of a closure formed according to an alternative embodiment.
Figure 12:
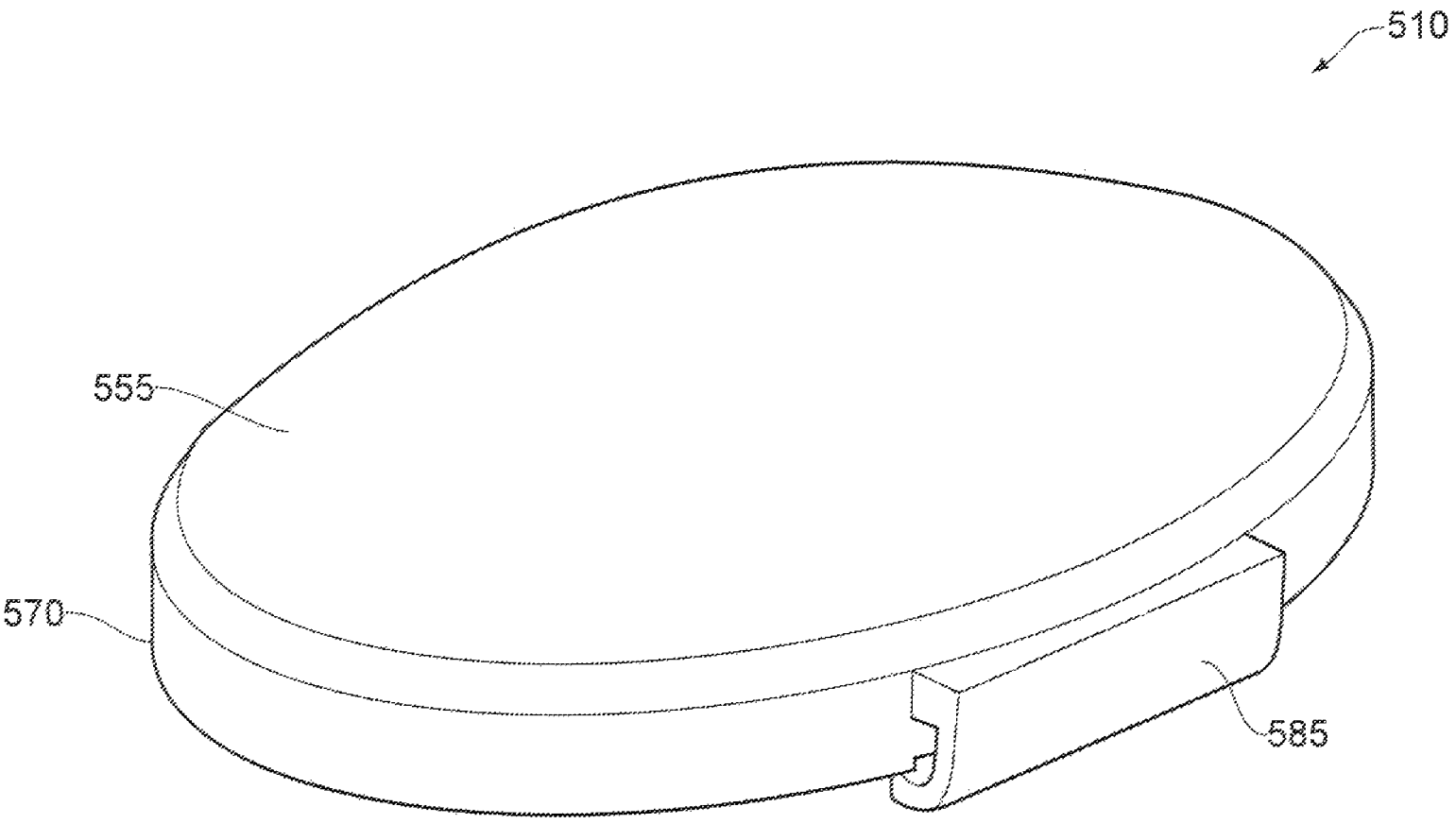
FIG. 12 is a rear perspective view of the closure of FIG. 11
Figure 13:
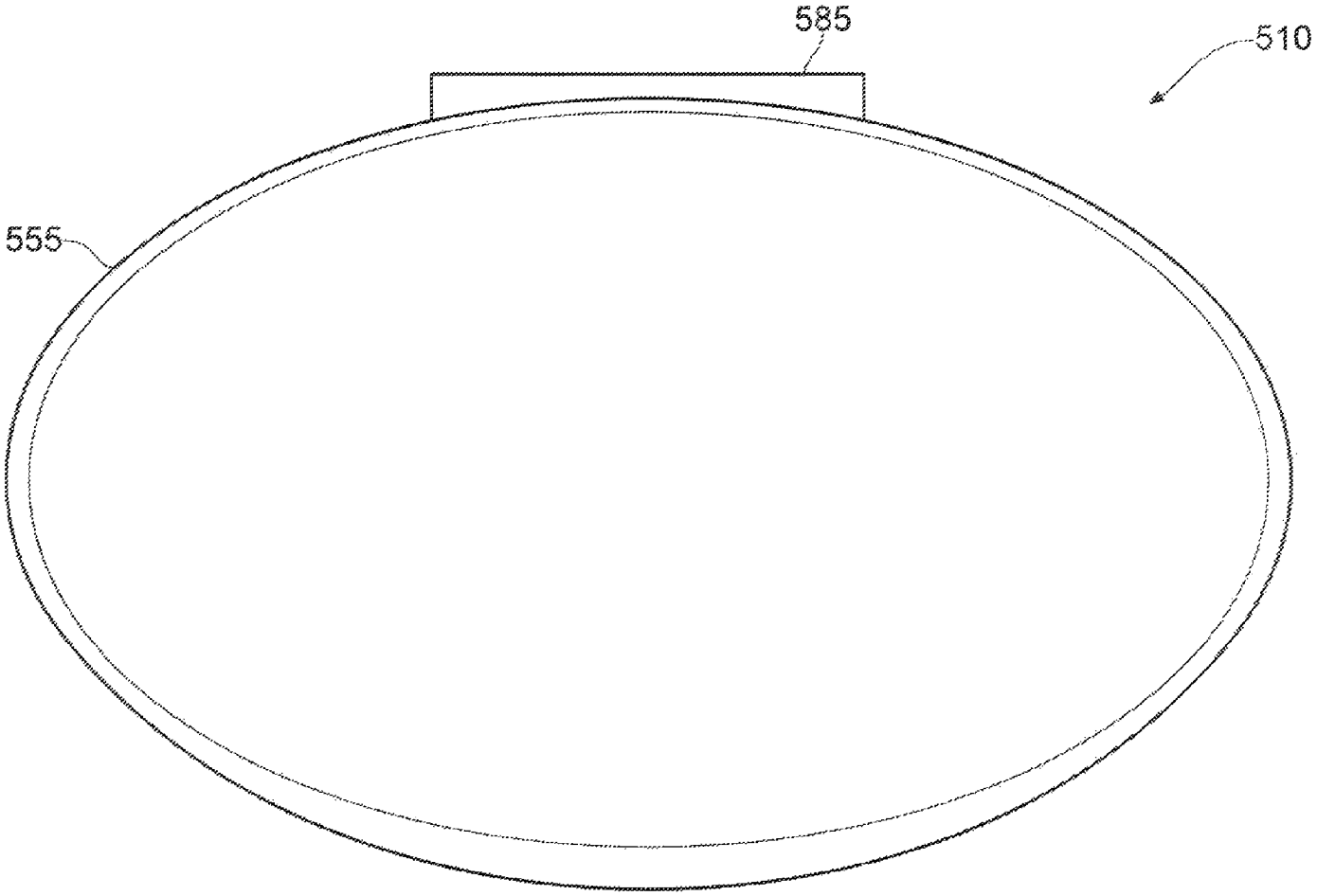
FIG. 13 is a plan view of the closure of FIG. 11.
Figure 14:
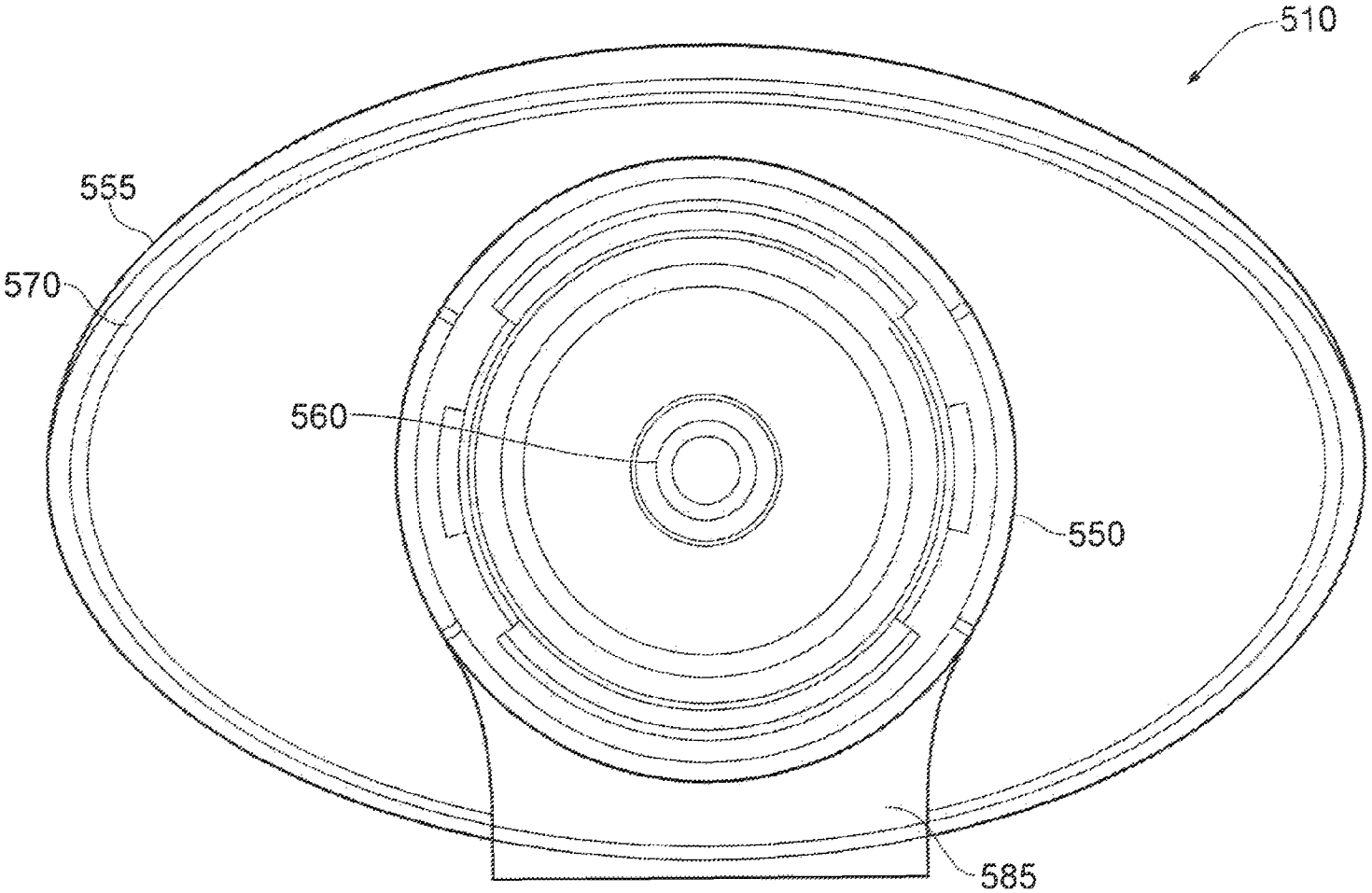
FIG. 14 is an underplan view of the closure FIG. 11.
Figure 15:
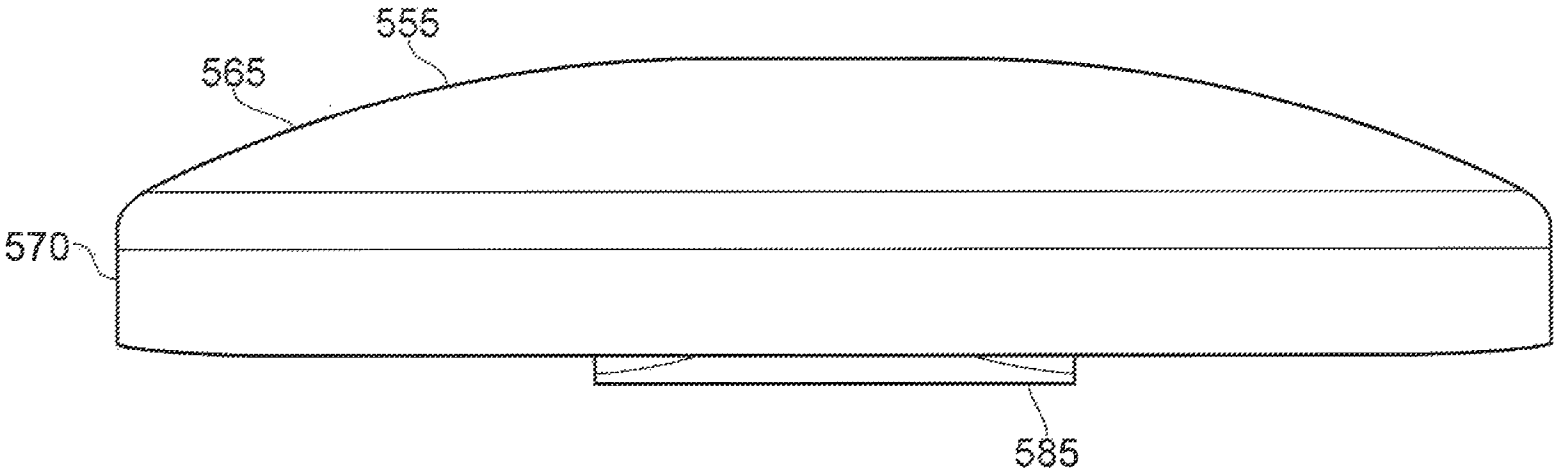
FIG. 15 is a front elevation of the closure of FIG. 11.
Figure 16:
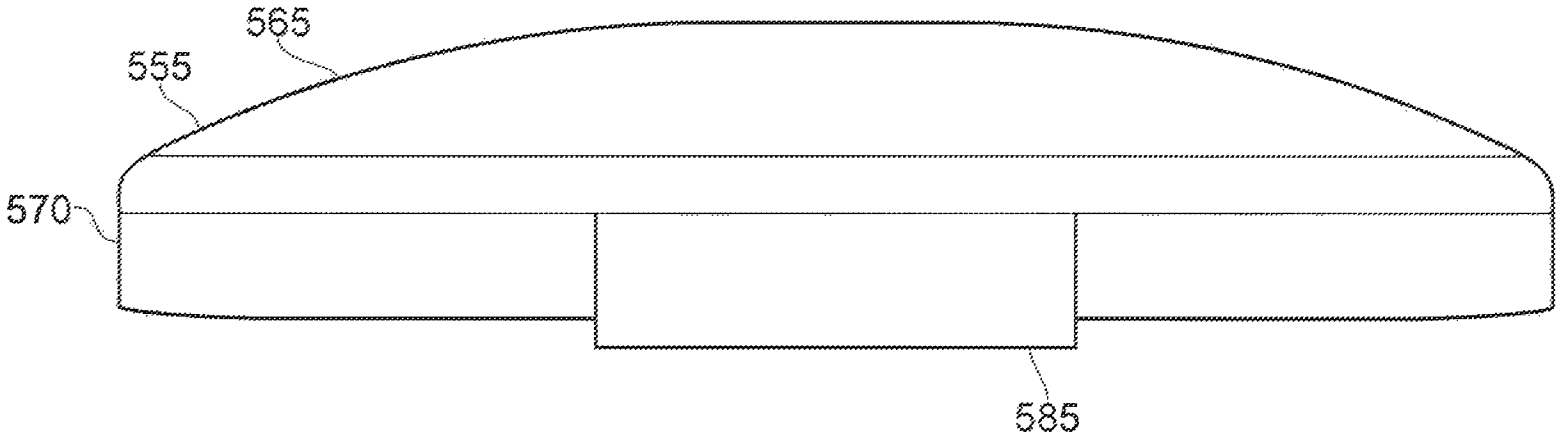
FIG. 16 is a rear elevation of the closure of FIG. 11.
Figure 17:
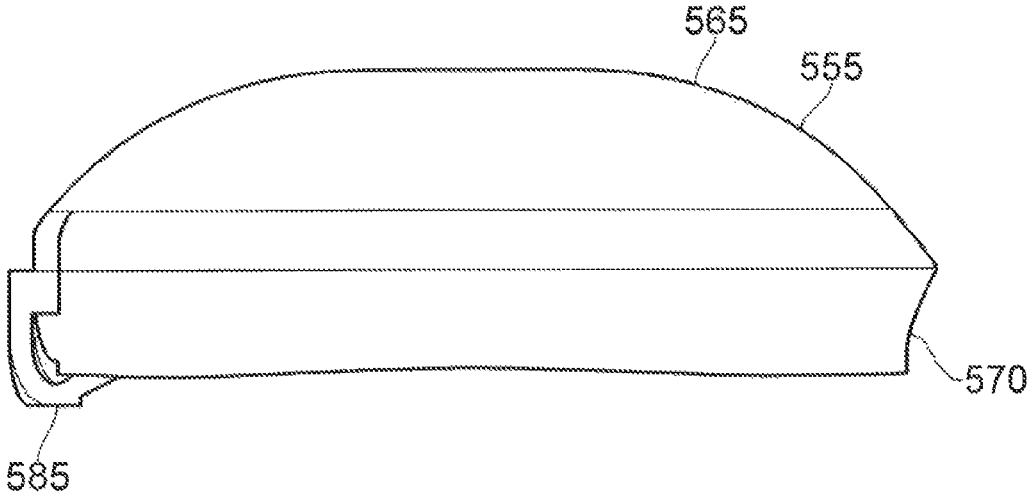
FIG. 17 is a side elevation of the closure of FIG. 11.
Figure 18:
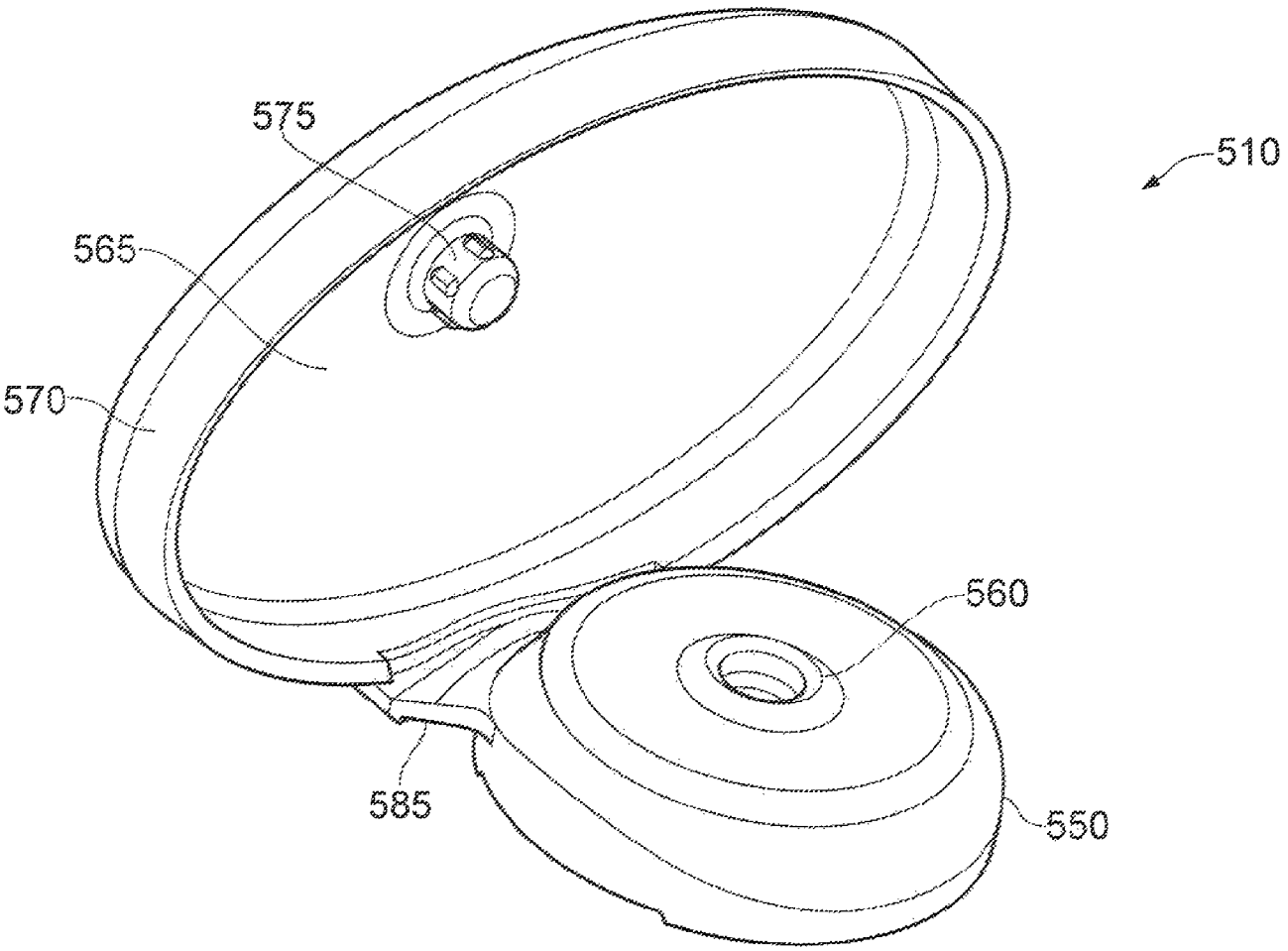
FIG. 18 is a front perspective view of the closure of FIG. 11 shown in an open position.
Figure 19:
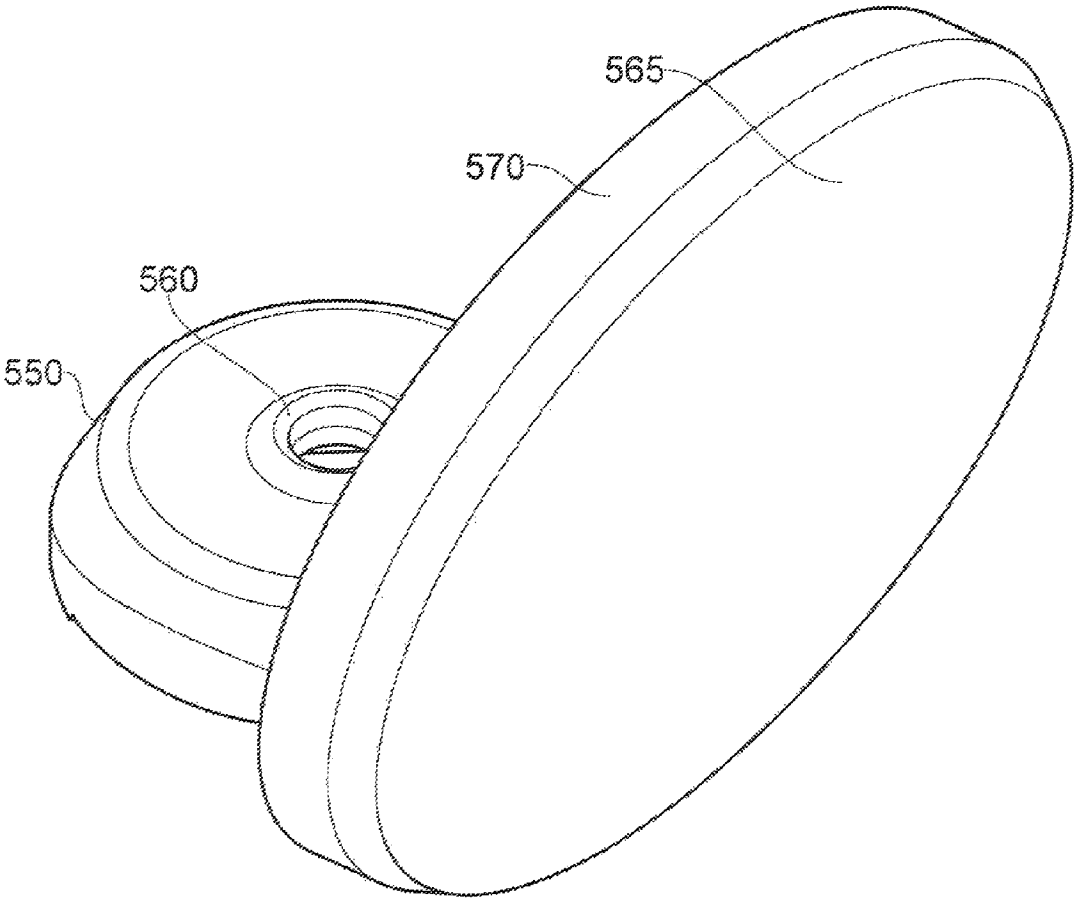
FIG. 19 is a rear perspective view of the closure of FIG. 18.
Figure 20:
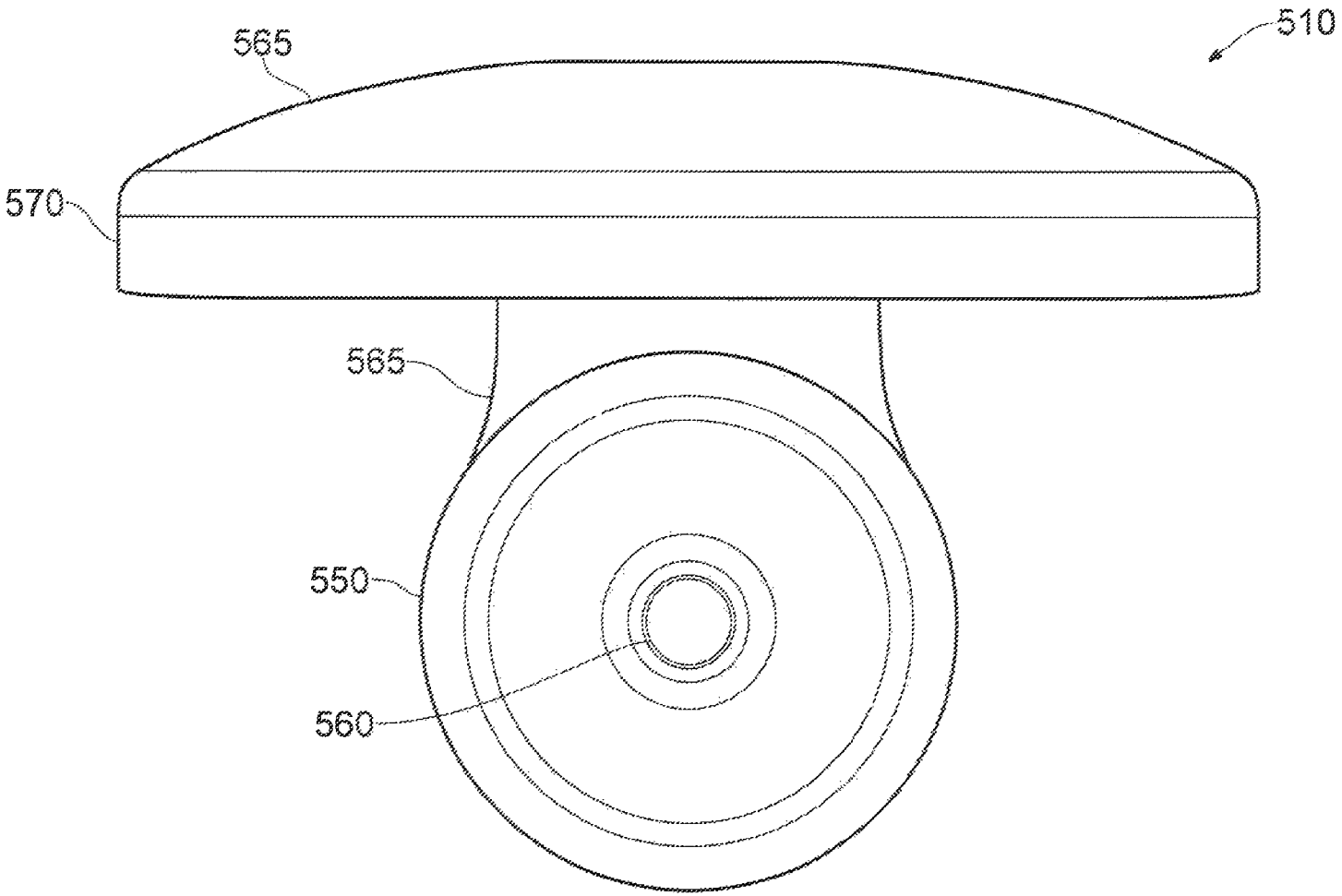
FIG. 20 is a plan view of the closure of FIG. 18.
Figure 21:
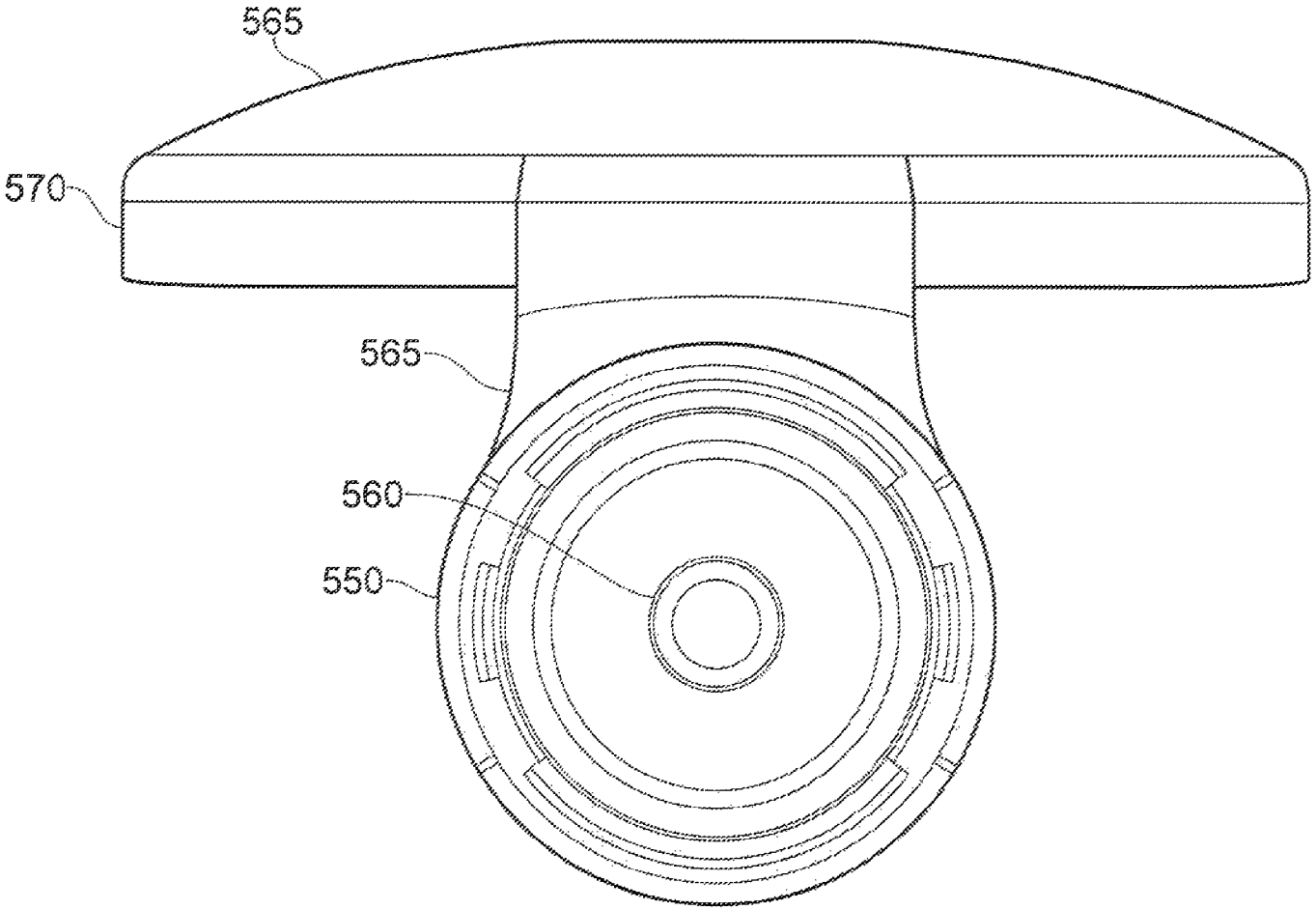
FIG. 21 is an underplan view of the closure of FIG. 18.
Figure 22:
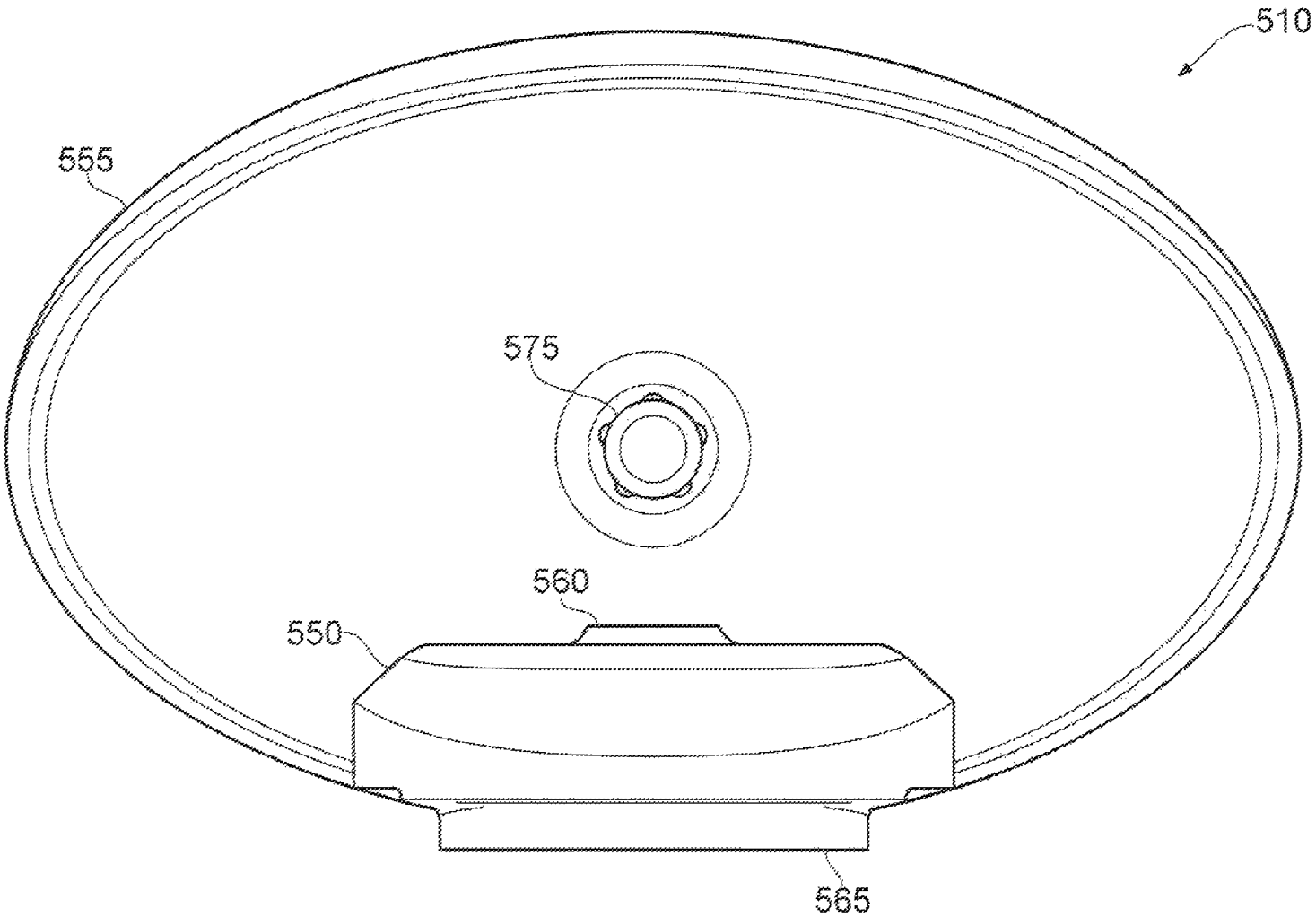
FIG. 22 is a front elevation of the closure of FIG. 18.
Figure 23:
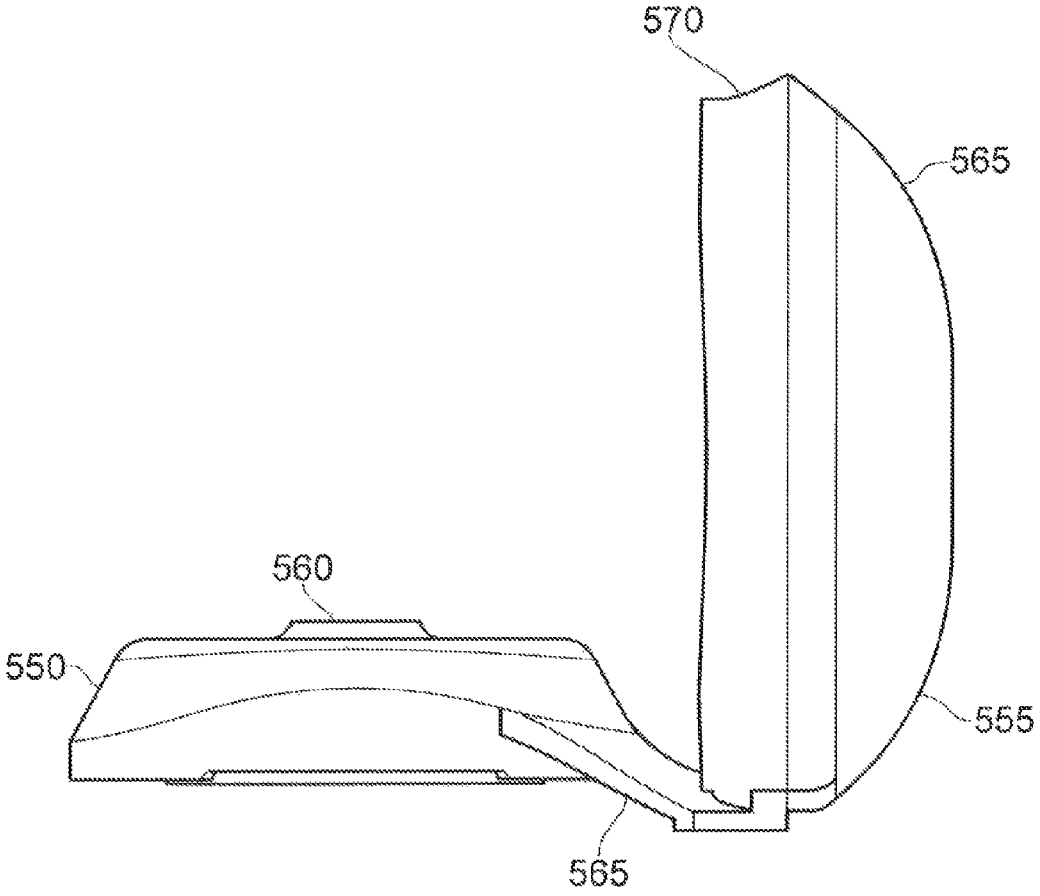
FIG. 23 is a side elevation of the closure of FIG. 18.

Referring now to FIG. 10 there as shown a closure 410 formed according to are alternative embodiment. The closure 410 comprises a generally circular base 450 and a generally circular lid 455. The lid 455 is slightly larger than the base 450 and thus a peripheral overhang region is present. In this embodiment the base 450 is connectable to a container using screw thread formations and the lid is snap fit onto the base.

Referring now to FIGS. 11 to 23 there is shown a closure 510 formed according to an alternative embodiment. The closure 510 is very similar to the closure 10 of FIGS. 1 to 5 and comprises a larger lid 555 hingedly connected to a smaller base 550. Because the base is smaller and located inboard of the periphery of the lid, the hinge extends inwardly from the periphery of the lid to connect to the base.

The invention claimed is:

1. A container closure comprising a base and a lid, said base and said lid being connected by a hinge, said base and lid each having a footprint, the lid having a periphery, the footprint of the lid being larger than the footprint of the base, in which the periphery of the lid is substantially flush fitting with a periphery of a container region onto which the lid closes, wherein the base is engageable onto a container by snap-fit engagement or by screw thread engagement, and the footprint of the lid is larger than the footprint of the base by an amount of at least 10%.

2. The container closure as claimed in claim 1, in which the hinge extends inwardly from the periphery of the lid to connect to the base.

3. The container closure as claimed in claim 1, in which the lid is sized to match the size of a container shoulder.

4. The container closure as claimed in claim 1, in which the base is sized to match the size of a container neck.

5. The container closure as claimed in claim 1, in which the shape of the base is substantially the same as the shape of the lid when viewed in plan.

6. The container closure as claimed in claim 1, in which the shape of the base is different to the shape of the lid when viewed in plan.

7. The container closure as claimed in claim 1, in which the base is located substantially centrally with respect to the lid when viewed in plan.

8. The container closure as claimed in claim 1, in which the base includes a dispensing orifice.

9. The container closure as claimed in claim 1, in which the closure is provided with an opening mechanism which allows for one-handed opening.

10. The container closure as claimed in claim 1, in which the base is circular and the lid is ellipsoidal.

11. The container in combination with the container closure as claimed in claim 1.

12. A container in combination with a container closure, the container having a container body comprising a shoulder region which merges into a top panel including an opening through which product carried in the container can pass, the container closure comprising a base and a lid, the base and lid being connected to a lid by a hinge, the base being connected on or to the top panel, said base and lid each having a footprint, the footprint of the lid being larger than the footprint of the base, the base including an inner periphery of the base and the lid including an outer periphery, characterized in that the lid is dimensioned to match the outline of the shoulder region on the container body such that the periphery of the lid is substantially flush fitting with the periphery of the shoulder region, onto which the lid closes, the outer periphery of the lid is spaced from the inner periphery of the base, and the footprint of the lid is larger than the footprint of the base by an amount of at least 10%.

13. The container of claim 12, in which the hinge extends inwardly from the periphery of the lid to connect to the base.

14. The container of claim 12, in which the shape of the base is substantially the same as the shape of the lid when viewed in plan.

15. The container of claim 12, in which the shape of the base is different to the shape of the lid when viewed in plan.

16. The container of claim 12, in which the base is located substantially centrally with respect to the lid when viewed in plan.

17. The container of claim 12, in which the base includes a dispensing orifice.

18. The container of claim 12, in which the closure is provided with an opening mechanism which allows for one-handed opening.

19. The container of claim 12, in which the base is circular and the lid is ellipsoidal.

20. The container of claim 12, in which the base includes engagement means for engaging a container.

* * * * *